United States Patent [19]

Bean

[11] 4,057,340

[45] Nov. 8, 1977

[54] SINGLE COMPONENT COLOR DEVELOPMENT SYSTEM

[75] Inventor: Lloyd F. Bean, Rochester, N.Y.

[73] Assignee: Xerox Corporation, Stamford, Conn.

[21] Appl. No.: 651,323

[22] Filed: Jan. 22, 1976

[51] Int. Cl.[2] ..... G03G 15/01

[52] U.S. Cl. ..... 355/4; 118/654

[58] Field of Search ..... 355/3 DD, 4; 118/637, 118/626, 629, 621, 653, 654; 427/14, 15, 21, 57; 222/414

[56] References Cited

U.S. PATENT DOCUMENTS

| | | | |
|---|---|---|---|
| 2,732,775 | 1/1956 | Young et al. | 355/3 DD X |
| 3,372,675 | 3/1968 | Tressel | 427/21 X |
| 3,563,734 | 2/1971 | Shely | 118/651 X |
| 3,963,341 | 6/1976 | Tully | 355/4 |

*Primary Examiner*—L. T. Hix
*Assistant Examiner*—Kenneth C. Hutchison
*Attorney, Agent, or Firm*—J. J. Ralabate; C. A. Green; H. Fleischer

[57] ABSTRACT

An apparatus in which a latent image is developed with particles. A support member advances the particles from a storage chamber to the development zone. In the development zone, the particles are separated from the support member and attracted to the latent image. This develops the latent image with these particles.

21 Claims, 2 Drawing Figures

SINGLE COMPONENT COLOR DEVELOPMENT SYSTEM

BACKGROUND OF THE INVENTION

This invention relates generally to an electrostatographic printing machine, and more particularly concerns an apparatus for developing a latent image.

The process of electrostatographic printing includes both electrographic printing and electrophotographic printing. In both of these processes, a latent image of the original document being reproduced is recorded on a surface. Electrophotographic printing is described in U.S. Pat. No. 2,297,691 issued to Carlson in 1942. As taught therein, a photoconductive member is charged to a substantially uniform potential. The charged photoconductive member is exposed to a light image of the original document. The light image selectively dissipates the charge in the irradiated areas and creates an electrostatic latent image on the photoconductive member. A variation of this process is a chargeless process wherein the photoconductive member is merely exposed to the light image in order to record the latent image thereon. This process does not require charging in order to sensitize the photoconductive surface. Electrographic printing creates a latent image corresponding to the original document to be reproduced without the use of a photoconductive material or a light image.

Irrespective of the method employed in the formation of a latent image, a viewable record thereof is usually produced by depositing particles thereon, i.e., the process of development. Development may be achieved by bringing the latent image into contact with a developer material. Typical developer materials employed in the art generally comprise toner particles, such as heat settable colored thermoplastic particles, which adhere electrostatically to coarser carrier granules, such as ferromagnetic granules. In the alternative, single component developer materials may be employed which utilize magnetic particles.

Various types of developing systems are employed in the art and include, amongst others, cascade development, magnetic brush development, powder cloud development, and liquid development. Magnetic brush systems achieve a substantially uniform density and, therefore, are used in numerous electrostatographic printing machines. Other types of hybrid systems are also frequently employed. For example, a combination of cascade and powder cloud development is also utilized.

Multi-color electrophotographic printing is substantially identical to the heretofore discussed process of black and white printing with the following distinctions. Rather than forming a total light image of the original document, the light image is filtered producing a single color light image which is a partial light image of the original document. This single color light image exposes the charged photoconductive surface to create successive single color latent images thereon. Each single color latent image is developed with particles complementary in color to the color of the filtered light image. These single color powder images are transferred to a sheet of support material, in superimposed registration with one another. In this manner, a multicolored powder image is formed on the sheet of support material and permanently affixed thereto. This forms a color copy corresponding to the original document.

U.S. Pat. No. 3,563,734 issued to Shelley in 1971 exemplifies chargeless electrophotographic printing and discloses a photoreceptor which is mounted in the form of an advanceable roll and carriage assembly. The photoreceptor is exposed to a light image of an original document and then passes adjacent to a magnetic brush developer assembly. The magnetic brush developer assembly has magnetic, conductive particles adhering thereto. As the photoreceptor, with the charge pattern recorded thereon, passes the magnetic brush assembly, the particles adhering thereto contact the charge pattern and are attracted thereto. These particles are then transferred from the photoreceptor to a sheet of support material secured to a transfer roll. Thereafter, the sheet of support material passes through a fusing device which permanently affixes the powder image thereto forming a black and white copy of the original document. Other relevant patents which exemplify the foregoing type of system are U.S. Pat. Nos. 3,617,124; 3,643,629; 3,739,749; and 3,764,313.

A multi-color variation of this process is disclosed in copending application Ser. No. 518,542 filed in Oct. of 1974, now U.S. Pat. No. 3,963,341. However, it has been found that it is extremely difficult to produce differently colored magnetic particles. Thus, a typical multi-color electrophotographic printing machine requires cyan, magenta and yellow toner particles. This problem may be obviated by employing the non-magnetic toner particles. However, when non-magnetic particles are employed, a magnetic brush system is not a suitable developer unit.

Accordingly, it is the primary object of the present invention to improve electrostatographic printing machines by providing development system suitable for use with single component, non-magnetic particles.

SUMMARY OF THE INVENTION

Briefly stated, and in accordance with the present invention, there is provided an apparatus for developing a latent image with particles.

Pursuant to the features of the present invention, a housing stores a supply of particles in a chamber thereof. A movable support member advances the particles from the chamber in the housing to a development zone closely adjacent to the latent image. Means are provided for attracting the particles from the chamber to the support member. When the support member advances the particles to the development zone, separating means dislodge the particles therefrom to render the latent image visible.

BRIEF DESCRIPTION OF THE DRAWINGS

Other objects and advantages of the present invention will become apparent upon reading the following detailed description and upon reference to the drawings, in which.

While the present invention will be described in conjunction with a preferred embodiment thereof, it will be understood that it is not intended to limit the invention to that embodiment. On the contrary, it is intended to cover all alternatives, modifications and equivalents as may be included within the spirit and scope of the invention.

DETAILED DESCRIPTION

Figure 1:
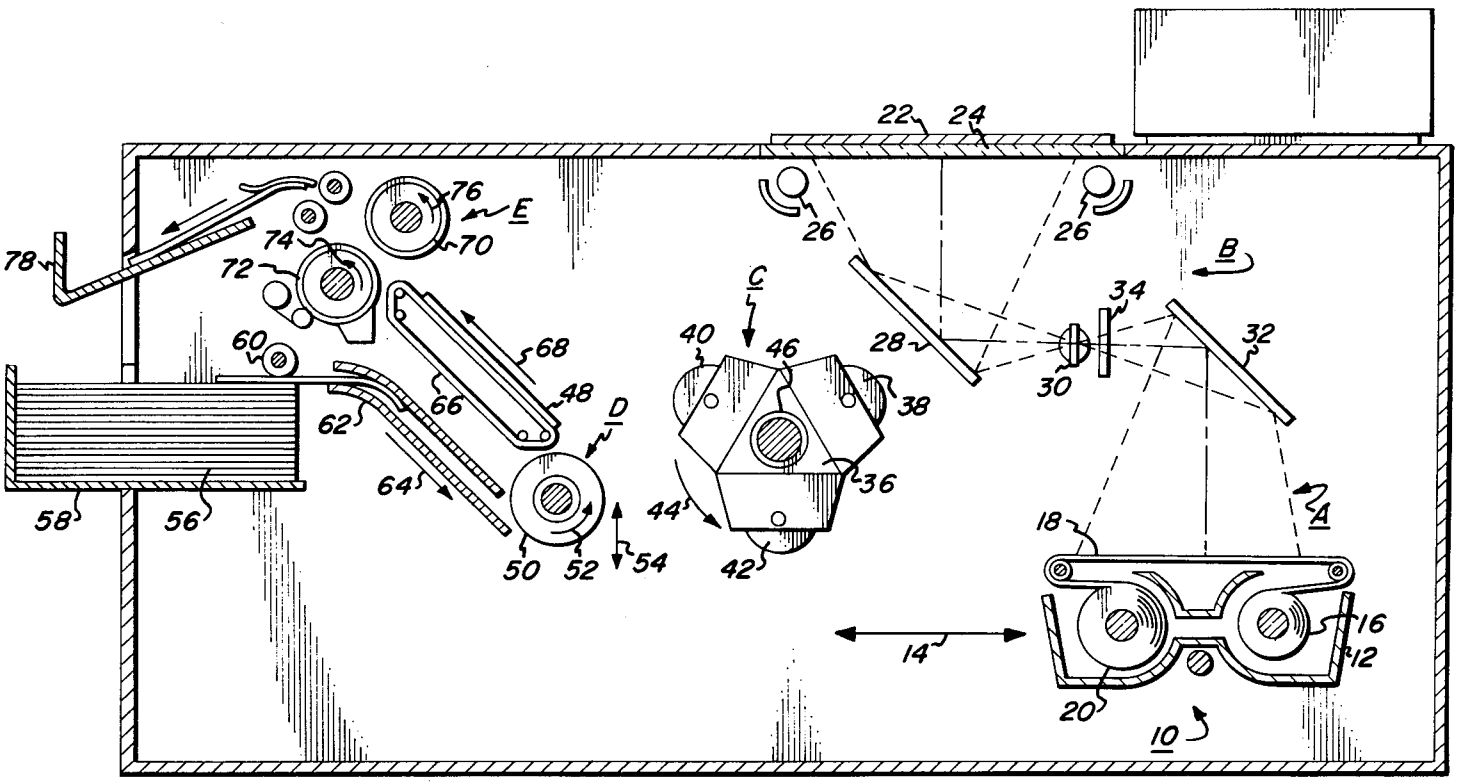
FIG. 1 is a schematic perspective view depicting a color electrophotographic printing machine incorporating the features of the present invention therein.

An electrophotographic printing machine adapted to form copies from a colored original document is depicted in FIG. 1. This printing machine incorporates therein the development system of the present invention and will be described hereinafter in greater detail to illustrate the basic printing process employed. Continued reference will be had throughout to the drawings, wherein like reference numerals have been used throughout to designate identical elements. Although the electrophotographic printing machine of the present invention is particularly well adapted for producing color copies, it should become evident from the following discussion that it is equally well suited for producing all types of copies and is not limited to the particular materials and apparatus described herein.

As depicted in FIG. 1, the electrophotographic printing machine employs a photoconductive member, indicated generally by the reference numeral 10. Photoconductive member 10 includes a carriage 12 mounted movably on rails in the printing machine. A rack and pinion drive system or other suitable means is employed to reciprocate carriage 12 in the direction of arrow 14. A supply spool 16 is mounted rotatably on carriage 12 with a flexible belt 18 of photoconductive material entrained thereabout. The exposed frames of flexible belt 18 are entrained about take-up spool 20. Take-up spool 20 is spaced from supply spool 16 and is also mounted rotatably in carriage 12. Supply spool 20 is periodically rotated by an indexing motor (not shown). The indexing motor is actuated by the machine program logic which advances flexible belt 18, the equivalent of one frame prior to the exposure thereof by the next successive filtered light image. Flexible belt 18 may be formed from a conductive layer and a panchromatic photoconductive layer with an insulating layer interposed therebetween. By way of example, a selenium or titanium dioxide alloy may be a suitable panchromatic photoconductive layer for belt 18. A layer of insulating material is secured to the photoconductive layer. Preferably, the insulating layer is made from Mylar, a trademark of the DuPont Co. A metal or conductive layer preferably formed from an aluminum vapor is secured to the insulating layer. The detailed structural configuration of a suitable photoconductive member is described in U.S. Pat. No. 3,563,734 issued to Shely in 1971, the relevant portions of that disclosure being hereby incorporated into the present application.

Initially, carriage 12 is positioned at exposure station A. At this time, a full frame of flexible belt 18 is exposed to a filtered light image of original document 22 disposed face down upon transparent platen 24. As shown in FIG. 1, lamps 26 are adapted to illuminate the entire original document 22. For example, lamps 26 may be a pair of flash lamps triggered at a voltage ranging from about 2,100 to about 3,100 volts. The light rays reflected from original document 22 are directed by mirror 28 through lens 30. Preferably, lens 30 is a six-element, split dagor type of lens having a front and back compound lens component with a centrally located diaphragm therebetween. Lens 30 forms a high quality image with a field angle of 31° and a speed of F/4.5 at a 1:1 magnification. The front lens component has three lens elements including, in the following order: a first lens element of positive power, a second lens element of negative power cemented to the first element, and a third lens element of positive power interposed between the second lens element and diaphragm. The back lens component also has three similar components positioned so that lens 30 is symmetrical. Specifically, the first lens element of the front component is a double convex lens, the second element a double concave lens, and the third element a convex-concave element. For greater details regarding lens 30, reference is made to U.S. Pat. No. 3,592,531 issued to McCrobie in 1971, the disclosure thereof being hereby incorporated into the present application. Interposed between lens 30 and mirror 32 is filter mechanism 34. Filter mechanism 34 includes a housing having a window therein. The window is positioned in the optical light path. The bottom and top walls of the housing include a plurality of tracks extending the entire width thereof. Each track is adapted to carry a colored filter therein. Three filters are employed, one being red, another blue, and the third green. The filters are locked into position out of the line of the housing window by means of a stop pin which extends up through an opening in the bottom of the housing to a respective track thereof. A solenoid arm, associated with each stop pin, retains the filter in the inoperative position. A spring, one being associated with each filter, moves the filter in its track from the inoperative position to the operative position in the housing window when the corresponding pin is removed from the track. The pin is removed from the filter path when the respective solenoid which actuated, thereby depressing the pin from the filter path. During the first exposure, the green filter is interposed into the optical light path and a green filtered light image is reflected by mirror 32 onto flexible belt 18. This forms a latent image corresponding to single color informational areas of the original document, i.e., the green portions of the original document. After the latent image is developed with particles complementary in color of the light image, the particles are transferred to the sheet of support material. Thereafter, flexible belt 18 is indexed and a fresh frame is positioned to be irradiated by the next successive single color light image. Thus, in operation, a green filtered light image is projected onto flexible belt 18 recording a green latent image thereon. This green latent image is developed with green absorbing magenta particles, i.e., particles complementary in color to the color of the single light image. These particles are non-magnetic and made from a thermoplastic heat settable material, or in lieu thereof may be non-magnetic and conductive. After the magenta particles are transferred from the flexible belt to the sheet of support material, the flexible belt is indexed placing the next frame in position for exposure. This frame is then exposed to a red filtered light image which, in turn, is developed with cyan particles. The cyan particles are then transferred to the sheet of support material in superimposed registration with the magenta particles. The flexible belt is then indexed so that a third frame is positioned for exposure to a blue filtered light image. The blue filtered light image is developed with yellow particles and these particles are transferred from flexible belt 18 to the sheet of support material in superimposed reigstration with the magenta and cyan particles. Thus, successive frames of flexible belt 18 are exposed to green, red and blue filtered light images, respectively. The detailed structural configuration of filter mechanism 34 is described in U.S. Pat. No. 3,775,006 issued to Hartman et al. in 1973. The relevant portions of that disclosure are hereby incorporated into the present application.

Figure 2:
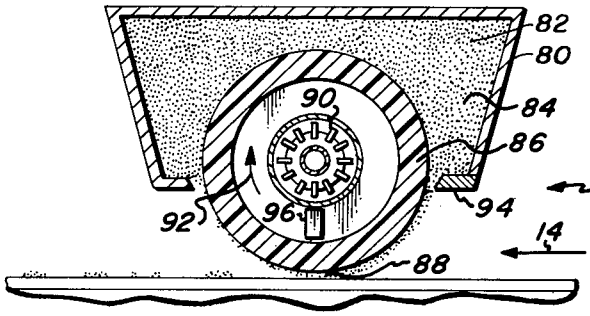
FIG. 2 is an elevational view illustrating the structure of one of the development units employed in the FIG. 1 printing machine.

Referring now to development station D, as shown in FIG. 1, frame 36 supports three developer units 38, 40, and 42, respectively. In operation, the machine logic rotates frame 36 to position the appropriate developer unit in operative communication with the latent image recorded on flexible belt 18. Thus, developer unit 38 having yellow particles therein is located adjacent flexible belt 18 when the latent image recorded thereon has been produced by a blue light image. Similarly, developer unit 40 having magenta particles therein is disposed adjacent flexible belt 18 when the latent image recorded thereon is produced by a green light image. Finally, developer unit 42 having cyan particles therein will be positioned adjacent flexible belt 18 when the charge pattern recorded thereon is produced by a red light image. These developer units are nearly identical to one another, the only distinction being the color of the particles contained therein. Hence, only developer unit 38 will be described in detail. Developer unit 38 is shown in FIG. 2 and will be discussed hereinafter with reference thereto. The particles in the respective developer units should have the appropriate charge relative to the latent image. This may be achieved by various methods. For example, each developer unit may have a corona generating device for charging insulating particles. Contrawise, conductive particles may be charged inductively. After the latent image recorded on flexible belt 18 is developed with the appropriately colored particles, carriage 12 advances to transfer station C. Then, frame 36 is rotated by a suitable indexing motor (not shown) having the drive shaft thereof coupled to shaft 46 of frame 36. The machine logic actuates the indexing motor to rotate frame 36 at the proper time sequence, insuring that the appropriate developer unit is located closely adjacent to belt 18.

After development, carriage 12 is advanced to transfer station C where the particles adhering to flexible belt 18 are transferred to a sheet of support material 48. Support material 48 may be a plain paper or a sheet of thermoplastic material, amongst others. At transfer station C, a transfer member or drum 50 is adapted to rotate in the direction of arrow 52. Transfer drum 50 recirculates support material 48 and is electrically biased to a potential of sufficient magnitude and polarity to attract the particles from the latent image recorded on flexible belt 18. The rotation of transfer drum 50 is in synchronism with the reciprocating movement of carriage 12 so as to transfer successive powder images from flexible belt 18 to support material 48, in superimposed registration with one another. Preferably, transfer drum 50 includes an aluminum tube having at least one layer of urethane secured thereabout. A direct current bias voltage is supplied by a suitable voltage source (not shown) to the aluminum shaft by a carbon brush and brass ring assembly (not shown). By way of example, the transfer voltage may range from about 150 to 450 volts D.C. Transfer drum 50 rotates in synchronism with the reciprocating movement of carriage 12. A flexible metal coupling permits transfer drum 50 to reciprocate in the direction of arrow 54. This enables transfer drum 50 to be moved into and out of contact with belt 18. Prior to preceding with the remaining processing stations, the sheet feeding path will be briefly described.

A stack of sheets of support material 56 is disposed in tray 58. Feed roll 60 contacts the uppermost sheet of the stack and advances the sheet into chute 62, in the direction of arrow 64. Gripper fingers (not shown) mounted on transfer drum 50 secure support material 48 thereto for movement in a recirculating path therewith. After a plurality of powder images (in this case, three) have been transferred to support material 48, the gripper finger space support material 48 from transfer drum 50. This permits the sheet of support material to be separated from transfer drum 50 so as to be advanced by endless belt conveyor 66 in the direction of arrow 68. Support material 48, with the multi-layered powdered image thereon is advanced to fusing station D.

At fusing station D, support material 48, with the multi-layered powder images thereon, passes between fuser roll 70 and backup roll 72. Fuser roll 70 is heated, preferably, to about 390° F. For example, a contact force ranging from about 0.5 to 3.0 pounds/linear inche is employed. Backup roll 72 rotates in the direction of arrow 74, and fuser roll 70 rotates in the direction of arrow 76. This type of system is exemplified by U.S. Pat. No. 3,666,247 issued to Banks in 1972, the relevant portions thereof being hereby incorporated into the present application.

After the multi-layered powder images have been permanently affixed to support material 48, support material 48 advances to catch tray 78. At the catch tray, the machine operator may readily remove the completed color copy from the printing machine.

Turning now to FIG. 2, the detailed structural configuration of developer unit 38 will now be described. As shown therein, flexible belt 18 advances in the direction of arrow 14 to move successive frames into operative communication with the corresponding developer unit. FIG. 2 illustrates the operation of developer unit 38 when a blue filtered light image has been projected onto flexible belt 18 recording the corresponding latent image thereon. Developer unit 38 includes a housing 80 defining a chamber 82 having a supply of yellow particles 84 therein. A movable support member 86 advances particles 84 from chamber 82 to development zone 88. Development zone 88 is the region where support member 86 is most closely adjacent to belt 18. Preferably, support member 86 is a cylindrical member journalled for rotary movement. A suitable drive motor coupled to a gear train rotates cylindrical member 86 at the appropriate angular velocity. Cylindrical member 86 has a plurality of apertures or holes therein. These holes extend in a radial direction from the outer surface to the inner surface thereof.

Each aperture in cylindrical member 86 is of a smaller diameter than the size of the smallest particle 84. Thus, when particles 84 are attracted to the exterior circumferential surface of cylindrical member 86 they cannot pass through the aperture therein. Particles 84 are attracted to the exterior circumferential surface of cylindrical member 86 by a pressure differential preferably ranging from about 0.5 psi to about 5 psi. This pressure differential is maintained by blower 90 creating an inwardly directed air flow from the exterior circumferential surface of cylindrical member 86 to the interior surface thereof through the apertures therein. The inwardly directed pressure differential attracts particles 84 to the exterior circumferential surface of cylindrical member 86 as cylindrical member 86 rotates in the direction of arrow 92 through the supply of particles 84.

Blade 94 has the trailing edge portion thereof secured to housing 80. The leading edge portion thereof is closely adjacent to cylindrical member 86 defining a gap therebetween. In this manner, blade 94 regulates the thickness of the layer of particles adhering to cylindrical member 86. Blade 94 acts as a seal preventing extraneous particles from escaping chamber 82. Thus, the unused particles are sheared from cylindrical member 86 and descend back into chamber 82 for subsequent re-use. As cylindrical member 86 rotates in the direction of arrow 92 particles 84 are advanced into development zone 88. A stationary interior member positioned opposed from development zone 88 and mounted interiorly of cylindrical member 86 may be employed to seal the holes therein. This removes the vacuum force in the development zone and allows the particles to be readily removed from cylindrical member 86. An ultrasonic transducer 96 is mounted interiorly of cylindrical member 86 and adapted to direct high frequency sound waves onto at least that portion of cylindrical member 86 in development zone 88. These sound waves separate or dislodge the particles from cylindrical member 86 forming a cloud of particles in development zone 88. A suitable transducer may be an electroacoustic transducer utilizing electrodynamic forces or magnetostriction. Sound waves produced by transducers of this type can provide variational pressure of up to 1 atmosphere or more at frequencies extending from the lower audio ranges to several megacycles. The dislodged particles forming the cloud in development zone 88 are attracted to the latent image recorded on flexible belt 18 rendering it visible.

In recapitulation, the electrophotographic printing machine hereinbefore described employs a new and improved development unit which supports single component non-magnetic particles to a latent image recorded on a photoconductive surface. These particles render the latent image visible. The foregoing process may be employed in a multi-color system by using differently colored particles. This is a chargeless system which produces successive single color powder images which may be transferred in superimposed registration with one another, to a common sheet of support material forming a multi-color copy corresponding to the original document. As heretofore described, the development system employs a movable support for attracting the particles thereto and advancing them to the development zone where they are dislodged and a powder cloud formed. The powder cloud renders the latent image recorded on the photoconductive surface visible.

It is, therefore, apparent that there has been provided in accordance with the present invention, a color electrophotographic printing machine employing a new and improved development unit that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing a latent image with particles, including:

a housing defining a chamber for storing a supply of particles therein;

a cylindrical member mounted rotatably in the chamber of said housing, said cylindrical member having a plurality of apertures therein with each aperture being smaller in size than the size of the smallest particle attracted thereto;

a blower mounted interiorly of said cylindrical member and arranged to generate an inwardly directed flow of air from the surface of said cylindrical member to the interior thereof forming a pressure differential attracting the particles thereto; and means for separating the particles from said cylindrical member as the particles advance to the development zone, wherein said cylindrical member positions the particles closely adjacent to the latent image.

2. An apparatus as recited in claim 1, wherein said separating means includes a transducer mounted interiorly of said cylindrical member and arranged to direct an ultrasonic wave into the development zone dislodging the particles from said cylindrical member to form a cloud of particles in the development zone.

3. An apparatus as recited in claim 2, further including a blade having the trailing edge thereof mounted on said housing with the leading edge thereof being closely adjacent to said cylindrical member defining a space therebetween to regulate the thickness of the layer of particles attracted to said cylindrical member.

4. An apparatus as recited in claim 3, wherein said cylindrical member is conductive.

5. An apparatus as recited in claim 4, wherein the particles are conductive.

6. An apparatus as recited in claim 3, wherein the particles are non-magnetic.

7. An electrostatographic printing machine of the type having a latent image corresponding to an original document being reproduced recorded on a member, wherein the improvement includes:

a housing defining a chamber for storing a supply of particles therein;

a cylindrical member mounted rotatably in the chamber of said housing, said cylindrical member having a plurality of apertures therein with each aperture being smaller in size than the size of the smallest particle attracted thereto;

a blower mounted interiorly of said cylindrical member and arranged to generate an inwardly directed flow of air from the surface of said cylindrical member to the interior thereof forming a pressure differential attracting the particles thereon; and means for separating the particles from said cylindrical member as the particles advance to the development zone, wherein said cylindrical member positions the particles closely adjacent to the latent image recorded on the member.

8. A printing machine as recited in claim 7, wherein said separating means includes a transducer mounted interiorly of said cylindrical member and arranged to direct an ultrasonic wave into the development zone dislodging the particles from said cylindrical member to form a cloud of particles in the development zone.

9. A printing machine as recited in claim 8, further including a blade having the trailing edge thereof mounted on said housing with the leading edge thereof being closely adjacent to said cylindrical member defining a space therebetween to regulate the thickness of the layer of particles to said cylindrical member.

10. A printing machine as recited in claim 9, wherein said cylindrical member is conductive.

11. A printing machine as recited in claim 10, wherein the particles are conductive.

12. A printing machine as recited in claim 9, wherein the particles are non-magnetic.

13. An electrophotographic printing machine for reproducing a colored original document on a sheet of support material, including:

a photoconductive member;

means for exposing said photoconductive member to successive color filtered light images to record successive latent images thereon, each latent image corresponding substantially to a discrete color contained in the original document;

means for developing each latent image recorded on said photoconductive member with single color non-magnetic particles forming successive single color powder images on said photoconductive member, said developing means comprising a frame member mounted rotatably in the printing machine, a plurality of housings mounted on said frame member, each of said housings defining a chamber for storing a supply of differently colored non-magnetic particles, a plurality of cylindrical members, each of said cylindrical members being mounted rotatably in the chambers of said housings and having a plurality of apertures therein with each aperture being smaller in size than the size of the smallest particle attracted thereto, a blower mounted interiorly of said cylindrical member and arranged to generate an inwardly directed flow of air from the surface of said cylindrical member to the interior thereof forming a pressure differential attracting the particles thereto; and means for separating the single color non-magnetic particles from said cylindrical members as the single color non-magnetic particles advance to the development zone, wherein said cylindrical members position the single color non-magnetic particles closely adjacent to the corresponding latent image recorded on said photoconductive member;

means for transferring, in superimposed registration, successive single color powder images from said photoconductive member to the sheet of support material; and means for fixing substantially permanently the superimposed powder images to the sheet of support material forming a colored copy of the original document.

14. A printing machine as recited in claim 13, wherein each of said separating means includes a transducer mounted interiorly of said cylindrical member and arranged to direct an ultrasonic wave into the development zone dislodging the particles from said cylindrical member to form a cloud of particles in the development zone.

15. A printing machine as recited in claim 14, wherein said developing means further includes a plurality of blades, each blade having the trailing edge thereof mounted on one of said housings with the leading edge thereof being closely adjacent to said cylindrical member defining a space therebetween to regulate the thickness of the layer of particles attracted to said cylindrical member.

16. A printing machine as recited in claim 15, wherein each of said cylindrical members is conductive.

17. A printing machine as recited in claim 16, wherein the particles are conductive.

18. A printing machine as recited in claim 15, wherein:

a first of said housings stores a supply of non-magnetic cyan particles in the chamber thereof;

a second of said housings stores a supply of non-magnetic magenta particles in the chamber thereof; and a third of said housings stores a supply of non-magnetic yellow particles in the chamber thereof.

19. A printing machine as recited in claim 18, wherein said transferring means includes a rotatably mounted drum having the sheet of support material secured releasably thereto.

20. A printing machine as recited in claim 19, wherein said exposing means includes:

a light source for illuminating the original document;

lens means, in a light receiving relationship with the light rays transmitted from the original document, for forming a light image of the original document; and means, interposed between said lens means and said photoconductive member, for filtering the light image to form successive single color light images.

21. A printing machine as recited in claim 20, wherein said fixing means includes means for heating the superimposed powder images transferred to the sheet of support material to affix permanently the powder images thereto.

* * * * *